United States Patent [19]

Anderson et al.

[11] Patent Number: 5,024,275

[45] Date of Patent: Jun. 18, 1991

[54] METHOD OF RECOVERING HYDROCARBONS USING SINGLE WELL INJECTION/PRODUCTION SYSTEM

[75] Inventors: Donald J. Anderson, Newport Beach; John H. Duerksen, Fullerton, both of Calif.; Doug J. McCallum; Mark Petrick, both of Calgary, Canada

[73] Assignee: Chevron Research Company, San Francisco, Calif.

[21] Appl. No.: 447,733

[22] Filed: Dec. 8, 1989

[51] Int. Cl.[5] ..... E21B 43/24

[52] U.S. Cl. ..... 166/303; 166/306; 166/272

[58] Field of Search ..... 166/250, 251, 252, 258, 166/263, 268, 272, 297, 298, 302, 303, 313, 369, 370, 383, 52, 57, 62, 106, 191, 306

[56] References Cited

U.S. PATENT DOCUMENTS 3,349,846 10/1987 Trantham et al. ..... 166/272 X 4,700,779 10/1987 Huang et al. ..... 166/263

*Primary Examiner*—William P. Neuder

*Attorney, Agent, or Firm*—Edward J. Keeling; David J. Power; Robert D. Touslee

[57] ABSTRACT

Production of viscous hydrocarbons is initiated by first injecting an injection fluid down at least two tubing strings in a wellbore having multiple tubing strings therein. Following an initiation phase, flow of injection fluid in the production tubing string is ceased, and production of formation fluid to the surface commenced in the heated tubing. The production of formation fluids is controlled, and entry of uncondensed steam from the formation into the wellbore avoided by maintaining a liquid level in the formation which is above the production perforations.

12 Claims, 4 Drawing Sheets

METHOD OF RECOVERING HYDROCARBONS USING SINGLE WELL INJECTION/PRODUCTION SYSTEM

BACKGROUND OF THE INVENTION

This invention relates generally to the production of viscous hydrocarbons from subterranean hydrocarbon-containing formations. Deposits of highly viscous crude petroleum represent a major future resource in the United States in California and Utah, where estimated remaining in-place reserves of viscous or heavy oil are approximately 200 million barrels. Overwhelmingly, the largest deposits in the world are located in Alberta Province, Canada, where the in-place reserves approach 1000 billion barrels from depths of about 2000 feet to surface outcroppings and occurring at viscosities in excess of one million c.p. at reservoir temperature. Until recently, the only method of commercially recovering such reserves was through surface mining at the outcrop locations. It has been estimated that about 90% of the total reserves are not recoverable through surface mining operations. Various attempts at alternative, in situ methods, have been made, all of which have used a form of thermal steam injection. Most pilot projects have established some form of communication within the formation between the injection well and the production well. Controlled communication between the injector and producer wells is critical to the overall success of the recovery process because in the absence of control, injected steam will tend to override the oil-bearing formation in an effort to reach the lower pressure area in the vicinity of the production well. The result of steam override or breakthrough in the formation is the inability to heat the bulk of the oil within the formation, thereby leaving it in place. Well-to-well communication has been established in some instances by inducing a pancake fracture. However, problems often arise from the healing of the fracture, both from formation forces and from the cooling of mobilized oil as it flows through a fracture toward the production well. At shallower depths, hydraulic fracturing is not viable due to lack of sufficient overburden. Even in the case where some amount of controlled communication is established, the production response is often unacceptably slow.

U.S. Pat. No. 4,037,658 to Andersen teaches a method of assisting the recovery of viscous petroleum, such as from tar sands, by utilizing a controlled flow of hot fluid in a flow path within the formation but out of direct contact with the viscous petroleum; thus, a solid-wall, hollow, tubular member in the formation is used for conducting hot fluid to reduce the viscosity of the petroleum to develop a potential passage in the formation outside the tubular member into which a fluid is injected to promote movement of the petroleum to a production position.

The method and apparatus disclosed by the Andersen '658 patent and related patents is effective in establishing and maintaining communication within the producing formation, and has been termed the "heated annulus steam drive", or "HASDRIVE" method. In the practice of HASDRIVE, a hole is formed in the petroleum-containing formation and a solid wall, hollow, tubular member is inserted into the hole to provide a continuous, uninterrupted flow path through the formation. A hot fluid is flowed through the interior of the tubular member out of contact with the formation to heat viscous petroleum in the formation outside the tubular member to reduce the viscosity of at least a portion of the petroleum adjacent the outside of the tubular member to provide a potential passage for fluid flow through the formation adjacent the outside of the tubular member. A drive fluid is then injected into the formation through the passage to promote movement of the petroleum for recovery from the formation.

U.S. Pat. No. 4,565,245 to Mims, describes a well completion for a generally horizontal well in a heavy oil or tar sand formation. The apparatus disclosed by Mims includes a well liner, a single string of tubing, and an inflatable packer which forms an impervious barrier and is located in the annulus between the single string of tubing and the well liner. A thermal drive fluid is injected down the annulus and into the formation near the packer. Produced fluids enter the well liner behind the inflatable packer and are conducted up the single string of tubing to the wellhead. The method contemplated by the Mims patent requires the hot stimulating fluid be flowed into the well annular zone formed between the single string of tubing and the casing. However, the inventors of the present invention believe such concentric injection of thermal fluid, where the thermal fluid is steam, would ultimately be unsatisfactory due to heat loss from the injected steam to the produced fluid and possible scaling in the production tubing due to inverse solubility and flashing of produced water to steam. Also, there is a possibility of scale deposition and build-up in the annulus.

Parallel tubing strings, the apparatus disclosed in U.S. Pat. No. 4,595,057 to Deming et al, is a configuration in which at least two tubing strings are placed parallel in the wellbore casing. Parallel tubing has been found to be superior in minimizing scaling and heat loss during thermal well operation.

Copending application Ser. No. 394,687, which is assigned to the assignee of the present application, achieves an improved heavy oil recovery from a heavy oil-containing formation utilizing a multiple tubing string completion in a single wellbore, such wellbore serving to convey both injection fluids to the formation and produce fluids from the formation. The injection and production would optimally occur simultaneously, in contrast to prior cyclic steaming methods which alternated steam and production from a single wellbore. The process disclosed in copending application Ser. No. 394,687, is termed the "Single Well Injection/ Production Steamflood", or "SWIPS". In the SWIPS process, it is not necessary the wellbore be substantially horizontal relative to the surface, but may be at any orientation within the formation. By forming a barrier to fluid flow within the wellbore between the terminus of the injection tubing string and the terminus of the production tubing string; and exhausting the injection fluid into the annulus near the barrier while injection perforations are at a distance along the wellbore from the barrier nearer the wellhead, the SWIPS wellbore casing is effective in mobilizing at least a portion of the heavy oil in the formation nearest the casing by conduction heat transfer.

The improved heavy oil production method disclosed by the copending application Ser. No. 394,687 is thus effective in establishing communication between the injection zone and production zone through the ability of the wellbore casing to conduct heat from the interior of the wellbore to the heavy oil in the formation nearer the wellbore. At least a portion of the heavy oil in the formation near the wellbore casing would be heated, its viscosity lower and thus have a greater tendency to flow. The single well method and apparatus of the SWIPS method and apparatus in operation therefore accomplishes the substantial purpose of an injection well, a production well, and a means of establishing communication therebetween. A heavy oil reservoir may therefore be more effectively produced by employing the method and apparatus of the SWIPS invention in a plurality of wells, each wellbore having therein means for continuous drive fluid injection, simultaneous produced fluid production and which incorporates multiple tubing strings within the wellbore casing.

There are several advantages of developing heavy oil and tar sand reserves through the method and apparatus of the SWIPS invention. A shorter induction period, usually a few days versus upward of several weeks or more, is possible with the SWIPS method over developing communication between a separate injection and production well. The distance between the injection point of injected fluid into the hydrocarbon-containing formation and the production point of produced fluids is distinctly defined in the SWIPS method, where the spacing between a separate injection and production well is less certain. Through the distinct feature of the wellbore casing conducting heat into at least a portion of the oil in the formation outside of the casing, there is less pressure and temperature drop between injection and production intervals, therefore production to the surface of produced fluids which retain more formation energy, is more likely accomplished with the SWIPS method and apparatus over previous separate well technology. In the production to the surface of formation fluids with the SWIPS method and apparatus, the production tubing temperature loss is significantly reduced through its location within the wellbore casing with the injection tubing string, and, therefore, bitumen and heavy oil in the produced fluids are less likely to become immobile and inhibit production to the surface.

The SWIPS method and apparatus, in practice along with conventional equipment of the type well known to persons experienced in heavy oil production for the generation of thermal fluids for injection and for treating of the resulting produced fluids would form a comprehensive system for recovery of highly viscous crude oil.

After drilling and completion of a SWIPS well which traverses a subterranean hydrocarbon bearing formation, it is desirable to develop fluid and thermal communication between the portion of the formation receiving injection fluid and the portion from which hydrocarbons are produced into the SWIPS wellbore. One means of achieving the advantageous result of quickly developing such communication is accomplished by flowing hot injection fluid into both strings of tubing from the steam source and pressuring the hot injection fluid into the formation through the wellbore perforations. In this manner, the hydrocarbon bearing formation is energized more rapidly than if injection fluid was pressured into the injection zone alone, from the injection tubing string only. When a predetermined quantity of injection fluid is flowed down both tubing strings and into the formation, flow of injection fluid into the production tubing string from the surface steam source may cease, the production tubing string may then be placed in flow communication with surface production facilities, and the flow reversed in the production tubing string within the SWIPS wellbore apparatus to transfer produced fluid from the hydrocarbon-bearing formation up the wellbore to the surface production facilities. In the continuous operation of the SWIPS method and apparatus, it is desired the system be controlled to optimize the amount of energy transferred from the injection fluid to the hydrocarbon-bearing formation. In a preferred embodiment of the SWIPS method where the injection fluid is steam, it is desired the steam fully condense within the formation and the introduction of uncondensed steam into the SWIPS wellbore be avoided. It has been determined that by maintaining the flow of produced fluid into the wellbore through the restriction of flow within the production tubing, a liquid seal in the form of liquid hydrocarbons and water is formed in the area surrounding the produced fluid inlet to the SWIPS wellbore. By avoiding the entry of uncondensed steam into the production tubing and SWIPS wellbore, the wire mesh sand screen or alternatively, a gravel pack, or other well completion material is protected from erosion and corrosion often caused by hot, high velocity fluid. By knowing the injection fluid pressure within the injection tubing string, the pressure required at the bottom of the SWIPS wellbore which ensures a liquid seal, may be calculated. By the method of the present invention, the SWIPS wellbore may be operated in a manner most efficient for conservation of pressure and temperature, and production of formation hydrocarbons.

DESCRIPTION OF THE PREFERRED EMBODIMENTS

Figure 1:
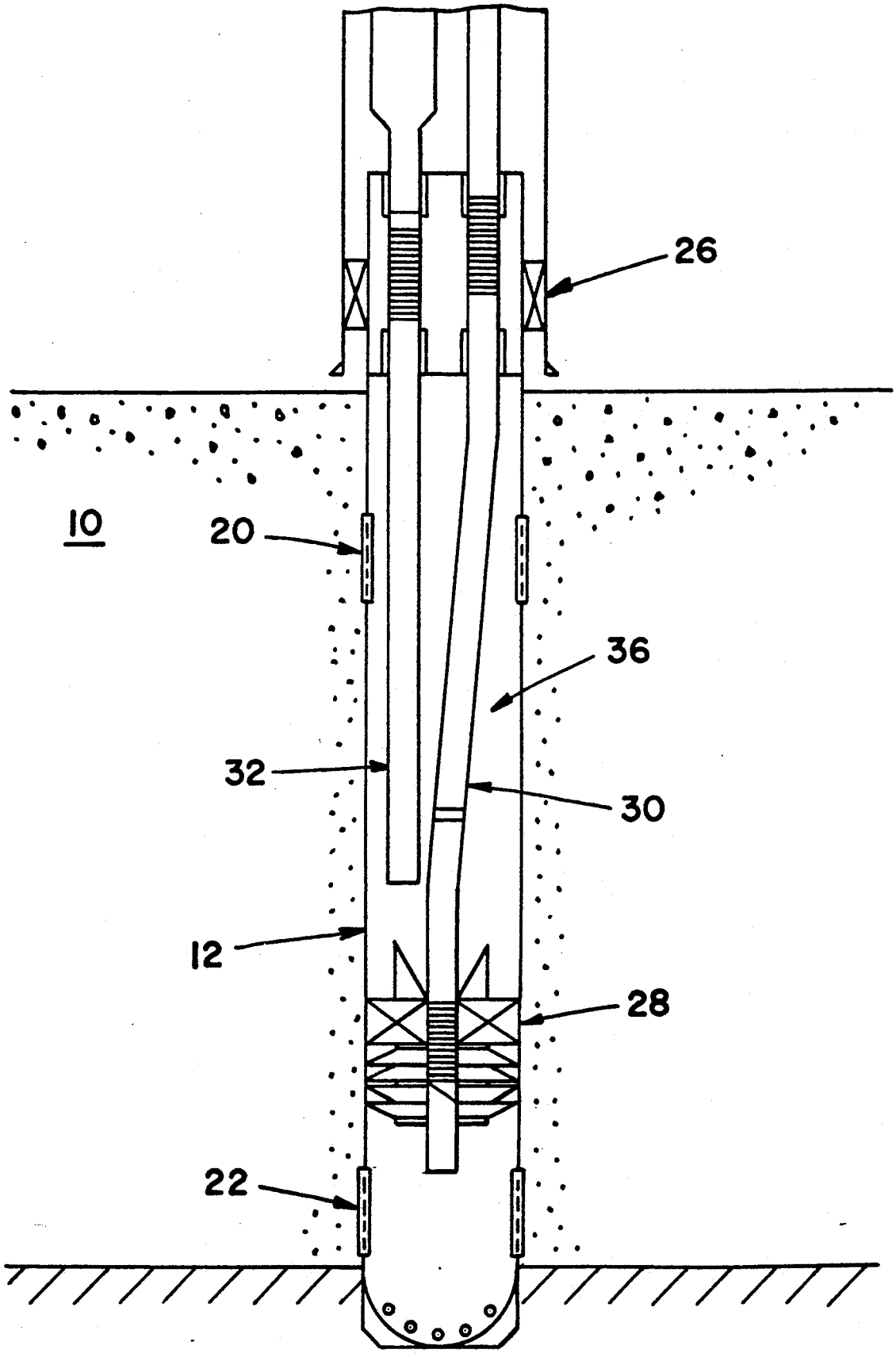
FIG. 1 is an elevation view in cross section of the single well injection and production system.

In the exemplary apparatus for practicing the SWIPS method, as depicted by FIG. 1, a subterranean earth formation 10 is penetrated by a wellbore having a casing 12. Perforations 20 and 22 provide fluid communication from the wellbore interior to the earth formation 10. A top packer 26 and bottom packer 28 are placed above the perforations 20 and 22, respectively.

A first tubing string 32 and a second tubing string 30 are placed within the wellbore casing 12, both tubing strings extending through top packer 26. Second tubing string 30 terminates at a depth shallower in the wellbore than bottom packer 28. An annular-like injection fluid flow path 36 is created by the space bounded by the top packer 26, bottom packer 28, and within the wellbore casing 12 exterior of either tubing string. Second tubing string 30 further extends through bottom packer 28, terminating at a depth below bottom packer 28.

When pressured injection fluid from a fluid supply source (not shown) is supplied to first tubing string 32, the injection fluid flows down first tubing string, and exhausts from the terminus of the tubing string into the annular-like fluid flow path 36. Continual supply of high pressure injection fluid to the first tubing string 32 forces the injection fluid upward in the annular flow path 36, toward the relatively lower pressured earth formation 10, through casing perforations 20. In the preferred embodiment of the SWIPS method, the injection fluid is steam. When the steam flows up the annular path 36 bounded by casing 12, thermal energy is conducted through the wellbore casing 12, and heating at least a portion of the earth formation 10 near the wellbore casing 12.

Hydrocarbon-containing fluid located within the earth formation 10 near the wellbore casing 12, having now an elevated temperature and thus a lower viscosity over that naturally occurring, will tend to flow along the heated flow path exterior of the casing 12 formed near the wellbore casing 12 by heat conducted from steam flow in the annular-like flow path 36 on the interior of the casing 12, toward the relatively lower pressure region near perforations 22. In the operation of the preferred embodiment of the SWIPS method and apparatus, produced fluids comprising hydrocarbons and water, including condensed steam, enter from the earth formation 12 through casing perforations 22 to the interior of the wellbore casing 12 below bottom packer 28. Produced fluid is continuously flowed into second tubing string 30 and up the second tubing string to surface facilities (not shown) for separation and further processing.

Figure 2:
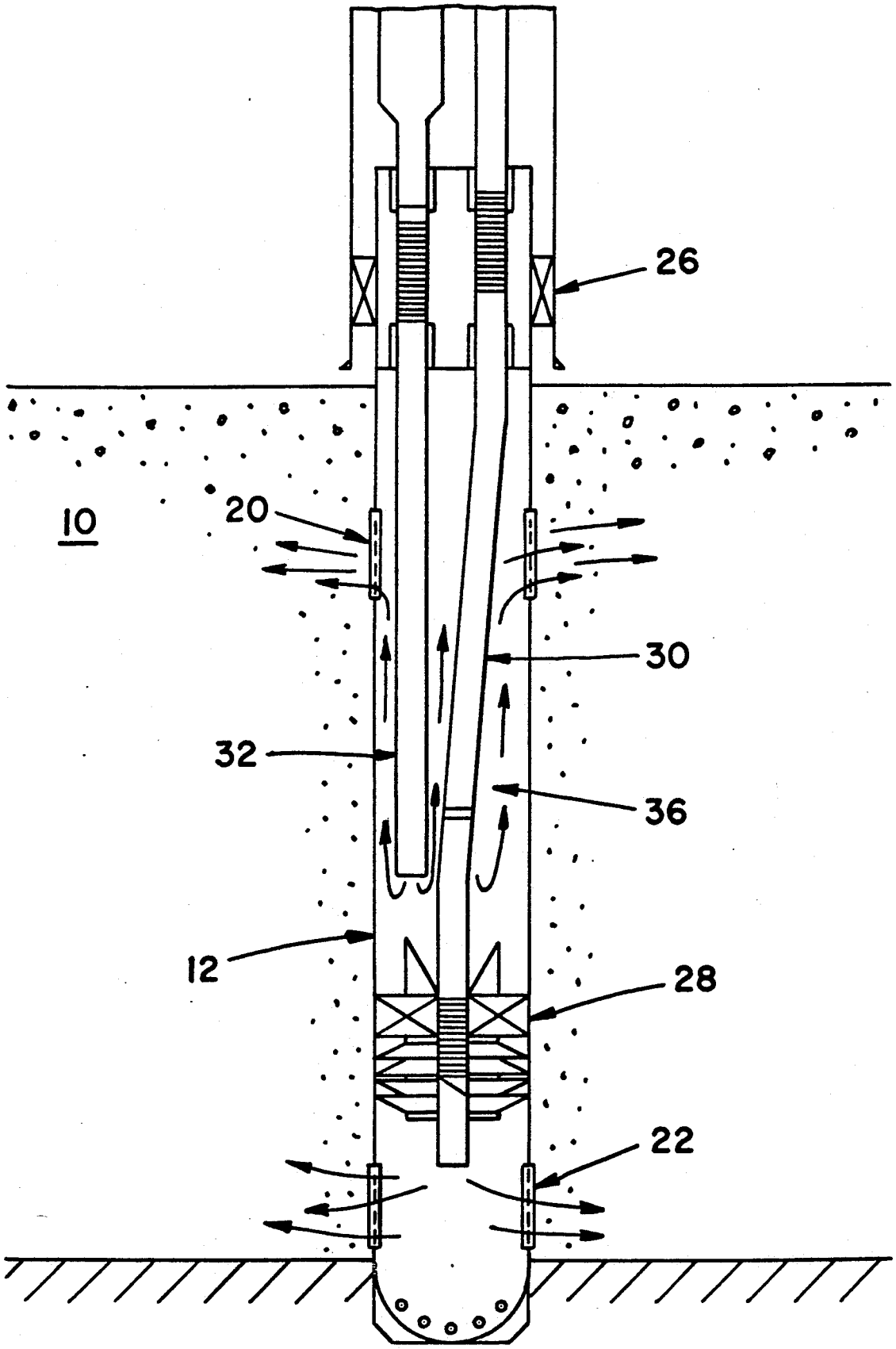
FIG. 2 is an elevation view in cross section of the single well injection and production system in the initiation configuration showing fluid injection through multiple tubing strings.

Referring now to FIG. 2, in a preferred method of establishing communication between the portion of the subterranean earth formation subjected to injection fluid, and the lower portion from which fluids will be produced, steam from an injection fluid supply source (not shown) is flowed from the surface down both the first tubing string 32 and the second tubing string 30. Injection fluid in the first tubing string 32 flows from the terminus of the first tubing string 32 along the annular-like flow path 36, exhausting from the SWIPS wellbore into the hydrocarbon-bearing formation through perforations 20. For at least a portion of the time during which injection fluid is flowed into first tubing string 32 and injection fluid is also flowed into second tubing string 30 from a surface injection fluid supply source (not shown). During this time, injection fluid in the second tubing string 30 is exhausted at the tubing tail and enters the hydrocarbon-bearing formation through casing perforations 22.

Figure 3:
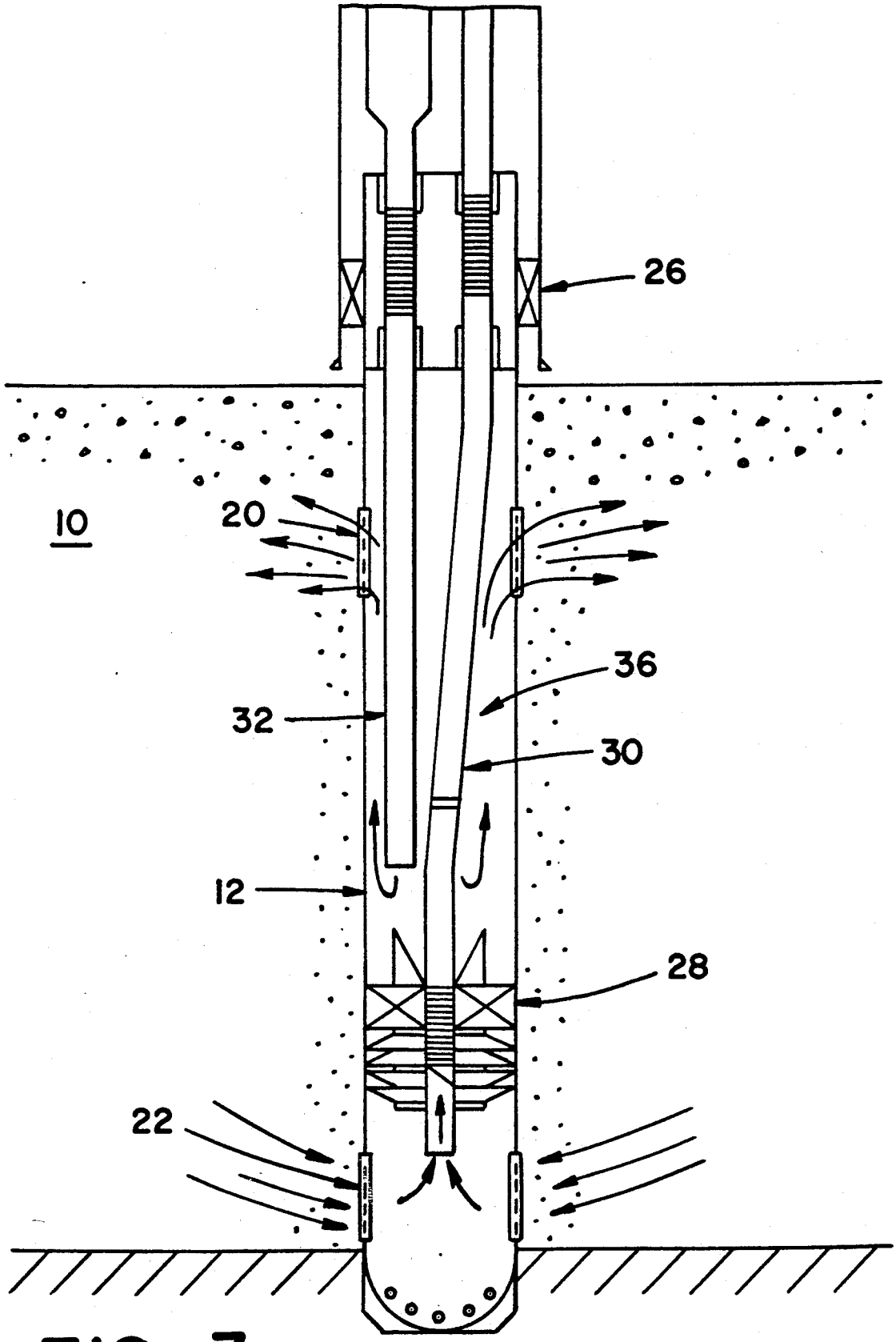
FIG 3 is an elevation view in cross section of the single well injection and production system in the normal operational mode.

Referring now to FIG. 3, when sufficient injection fluid has entered the hydrocarbon-bearing formation to reduce the viscosity of at least a portion of the reservoir fluid sought to be produced and sufficient energy exists in the formation, the second tubing string 30 is disconnected from the injection fluid supply source (not shown), and fluid communication is established between the second tubing string 30 and production facilities (not shown). Due to a decreased pressure now existing in the second tubing string 30 relative to the pressure within the hydrocarbon-containing formation 10, formation fluid will tend to flow from the hydrocarbon-containing formation 10 toward the terminus of the second tubing string 30 through perforations 22. It is preferred to minimize the duration of time between cessation of injection fluid flow through second tubing string 30 and the flowing of formation fluids in a reverse direction through second tubing string 30, in order to minimize the loss of thermal energy and thus minimize the flowing viscosity of the fluids produced from hydrocarbon-containing formation 10.

Figure 4:
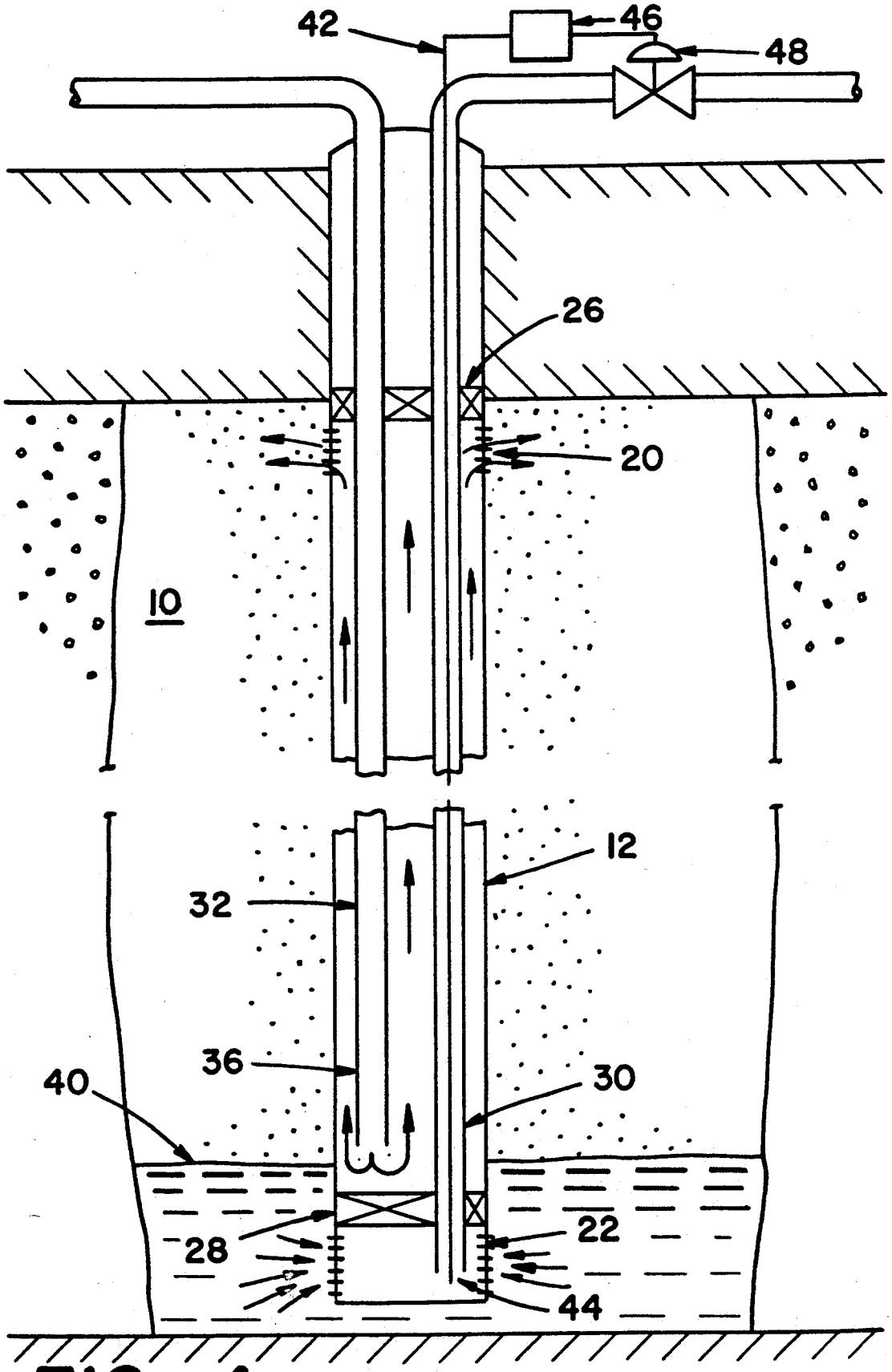
FIG. 4 is an elevation view in cross section of the single well injection and production system and control means during normal operation.

Referring now to FIG. 4, to avoid the entry of uncondensed steam into the gravel pack or wire mesh sand screen area located exterior of the wellbore near perforations 22, the level of formation fluid interface 40 at a sufficient distance in the hydrocarbon-bearing formation above perforations 22 is created and maintained. The level of interface 40 above perforations 22 is directly proportional to the difference in pressure between the injection fluid in first tubing string 32 and pressure at the bottom hole fluid inlet to second tubing string 30. It is thus possible to sense the pressure existing in second tubing string 30, compare it to the injection fluid pressure existing in first tubing string 32, or any point along the injection fluid flow path defined from the injection fluid supply source and the terminus of the first tubing string 32, and determine the level of the formation fluid interface 40 above perforations 22, based on the difference therebetween. In one embodiment, bottom hole pressure in the second tubing string 30 is sensed utilizing a well-known "bubble-tube" or "capillary tube" device which comprises a length of small diameter metallic tubing 42 extended from the surface to the downhole environment for which pressure information is desired. The indication of pressure existing at the downhole terminus of the small diameter metallic tubing 44 is transmitted via a gas, typically an inert gas such as nitrogen, to instrumentation 46 placed at the surface. Based upon the indicated pressure, an estimate of fluid level interface 40 height above the terminus 44 is used to control the amounts of fluid restriction applied to the produced fluid stream in the second tubing string 32 through incorporation of a surface control valve 48. Thus, the liquid level interface 40 is proportional to the difference in pressure ($\Delta P_1$) between Steam Injection Pressure (SIP), and Bottomhole Pressure (BHP), and is represented by the equation:

$$\Delta P_1 = BHP - SIP.$$

By the method of the present invention, fluid interface is maintained at sufficient level above perforations 22 to form a liquid seal at the fluid entrance to the SWIPS wellbore, thus avoiding the contact of uncondensed injection fluid with the gravel pack, wire mesh sand screen or other well completion device which may be subject to damage from contact with hot or high velocity injection fluid.

Although the present invention has been described with preferred embodiments, it is to be understood that modifications and variations may be resorted to without departing from the spirit and scope of the present invention, as those skilled in the art will readily understand. Such modifications and variations are considered to be within the purview and scope of the appended claims.

What is claimed is:

1. A method for enhancing the recovery of viscous hydrocarbons from a subterranean formation wherein said formation is traversed by a cased wellbore having a first tubing string, a first packer and a second tubing string, a second packer combination therein, said wellbore casing having a thermal communication path lying contiguous with the formation when a drive fluid is injected down said second tubing string and accesses a thermal zone parenthetically defined by said packers, said thermal communication path directing produced fluids from the formation to said first tubing string for recovery, the improvement comprising:

flowing said drive fluid down both said first and said second tubing string to expedite heating of said wellbore casing;

maintaining drive fluid flow down both the first and the second tubing string until said thermal communication path is established and the viscosity of at least a portion of the viscous hydrocarbons in said formation near the wellbore casing is reduced for direction along said thermal communication path;

reversing the flow within the first tubing string to produce said hydrocarbons from the formation to the surface as said hydrocarbons traverse the thermal communication path adjacent said wellbore casing.

2. The method of claim 1 wherein the injection fluid is steam.

3. The method of claim 2 wherein the injection fluid is hot water.

4. The method of claim 1 further comprising the step of setting a dual string packer defining the upper boundary of the thermal zone.

5. The method of claim 4 wherein the second tubing string is terminated low in the thermal zone substantially maximizing the physical distance within the thermal zone the injection must flow from the tail of the second tubing string prior to exiting the wellbore through casing perforations adjacent the dual string packer.

6. The method of claim 1 wherein the flow of produced fluids from the production zone is facilitated with a pump.

7. The method of claim 1 wherein the flow of produced fluids from the production zone is accomplished by maintaining the bottom hole at a pressure sufficient to force produced fluids to the surface.

8. The method of claim 1 further comprising the step of maintaining a liquid level within the formation at sufficient height above a terminus of said first tubing string to avoid introduction of uncondensed fluid into said first tubing string form the formation.

9. The method of claim 8 wherein the liquid level is maintained by restricting the flow of produced fluids within the production tubing string.

10. The method of claim 9 wherein the restriction to flow within the production tubing is achieved by a valve in fluid communication with the production tubing located at the surface and which is controlled in proportion to the pressure existing in the wellbore at the terminus of the production tubing.

11. The method of claim 10 wherein the bottom hole pressure is sensed with a bubble tube device.

12. The method of claim 8 wherein the liquid level within the formation is maintained by monitoring the pressure within the injection tubing and the pressure at the surface of the production tubing; and restricting the flow within the production tubing to maintain a predetermined bottom hole pressure according to the equation, $BHP = SIP + \Delta P_1$, where BHP = Bottomhole pressure SIP = Steam injection pressure $\Delta P_1$ = Pressure differential between top of fluid and the production tubing inlet.

* * * * *